US007544911B2

(12) United States Patent
Socha-Leialoha

(10) Patent No.: US 7,544,911 B2
(45) Date of Patent: Jun. 9, 2009

(54) MODEL RAILROAD SWITCH ACTUATORS

(76) Inventor: John Socha-Leialoha, 14725 NE. 20th, Suite D-100, Bellevue, WA (US) 98007

( * ) Notice: Subject to any disclaimer, the term of this patent is extended or adjusted under 35 U.S.C. 154(b) by 95 days.

(21) Appl. No.: 11/656,884

(22) Filed: Jan. 22, 2007

(65) Prior Publication Data

US 2007/0187221 A1 Aug. 16, 2007

Related U.S. Application Data

(60) Provisional application No. 60/761,024, filed on Jan. 20, 2006.

(51) Int. Cl.
*H01H 21/82* (2006.01)

(52) U.S. Cl. ..... 200/559; 200/547

(58) Field of Classification Search ..... 200/330–334, 200/337, 338, 538, 547, 559
See application file for complete search history.

(56) References Cited

U.S. PATENT DOCUMENTS

| | | | | | |
|---|---|---|---|---|---|
| 4,771,145 | A * | 9/1988 | Davis, Jr. | ..... | 200/331 |
| 4,870,232 | A * | 9/1989 | Hoogland | ..... | 200/331 |
| 5,017,746 | A * | 5/1991 | Guimarin | ..... | 200/331 |
| 5,055,645 | A * | 10/1991 | Hull et al. | ..... | 200/331 |
| 5,288,958 | A * | 2/1994 | Grunert et al. | ..... | 200/331 |
| 5,396,037 | A * | 3/1995 | Moore et al. | ..... | 200/331 |
| 5,422,453 | A * | 6/1995 | Smith et al. | ..... | 200/329 |
| 5,590,759 | A * | 1/1997 | Hawkins et al. | ..... | 200/331 |
| 5,782,342 | A * | 7/1998 | Hewitt et al. | ..... | 200/331 |
| 6,403,903 | B1 * | 6/2002 | Montano et al. | ..... | 200/331 |
| 6,595,051 | B1 * | 7/2003 | Chandler, Jr. | ..... | 73/301 |
| 6,710,274 | B2 * | 3/2004 | Whetzel et al. | ..... | 200/330 |
| 6,822,177 | B1 * | 11/2004 | LaPlante | ..... | 200/331 |
| 6,982,391 | B2 * | 1/2006 | Da Dalt | ..... | 200/43.04 |
| 7,235,753 | B1 * | 6/2007 | Forest | ..... | 200/331 |
| 2008/0128257 | A1 * | 6/2008 | Kloth et al. | ..... | 200/560 |

* cited by examiner

*Primary Examiner*—Michael A Friedhofer
*Assistant Examiner*—Lisa N Klaus
(74) *Attorney, Agent, or Firm*—Graybeal Jackson LLP

(57) ABSTRACT

A remotely operable switch actuator for model train having a housing adapted to receive an electrical switch having a toggle, a slider translationally received by the housing and linked to the toggle, and a fulcrum for receiving mid portion of a connecting rod. The fulcrum may be translationally received by the housing, which when moved, alters the throw of the connecting rod. In certain embodiments of the invention, the slider has means for receiving a first end portion of the connecting rod where the second end of the connecting rod may engage a throw bar. In other embodiments, the actuator further includes a lever pivotally received by the housing, and linked at one end to the slider and the other end linkable to the connecting rod at one end thereof.

20 Claims, 8 Drawing Sheets

MODEL RAILROAD SWITCH ACTUATORS

CROSS-REFERENCE TO RELATED APPLICATION

Priority under 35 U.S.C. §119(e) is claimed to application Ser. No. 60/761,024, filed on 20 Jan. 2006, which is incorporated herein by reference.

BACKGROUND OF THE INVENTION

Description of the Prior Art

In the field of model railroading, track layouts usually comprise one or more mainlines and one or more sidings. As in conventional railroad lines, sidings are often used for stationary locomotives and cars; for adding, subtracting or substituting locomotives or cars such as in a makeup, or for bypasses; and can be found in crossovers, double ended sidings, lapped sidings, single ended sidings, ladders, wyes, etc. Switches are used in these arrangements for redirecting locomotives and/or cars from a mainline to a siding or for bypassing on a siding.

While there are many forms of switches, each switch generally includes the following components:

Points are the movable rails that guide the wheels towards one diverging track or the other. They generally have tapered ends.

A frog refers to structure at the crossing point of two rails. This can be assembled out of several appropriately cut and bent pieces of rail or can be a single casting.

A guard rail is a short piece of rail placed alongside the main rail opposite the frog. These exist to ensure that the wheels follow the appropriate flangeway through the frog and that the train does not derail. Generally, there are two of these for each frog, one by each outer rail. Guard rails on the outer rails are not needed with one-piece cast frogs as they are part of the casting.

The points can be moved either by a switch motor, which in real-world applications is an electric or pneumatic mechanism that aligns the points with one of the diverging routes, or a points lever, ground throw, or switchstand. These structures perform the same function as a switch motor, but are manually operated.

These structures and their accompanying hardware are usually mounted to a pair of long ties or sleepers that extend from the switch motor or switchstand to the points.

A throw bar mechanically links the switch motor or switchstand to the points.

Serious model railroad hobbyists strive for realism. To this end, simple solenoid operated switches are not favored; their movement is proportionately too rapid and do not emulate the relatively slow and steady movement of real railroad switches. Prior efforts to emulate realistic points movement have employed wired switches using stall motors, such as those sold by Circuitron under the brand name "Tortoise." However, these switches require a source of electric power, an electrical switch and related wiring. Moreover, control over the relative speed of the switch is generally not possible, thus relegating the hobbyist to the switch speed selected by the manufacturer.

SUMMARY OF THE INVENTION

The present invention is directed to both manually operated switch actuators that require no electricity for operation and electronic remote control switch actuators. Manual switch actuators according to the invention comprise below layout embodiments or above layout embodiments, while R/C switch actuators comprise below layout bas embodiments, unless the electronics package and drive motor are housed in an aesthetic enclosure. In below layout embodiments, a hole is created in the layout to permit passage of a connecting rod, which may be constructed from a rigid or flexible material, the selection of which is generally considered a design consideration. One end of the connecting rod is linked to the throw bar (the distal end), which is in turn linked to the points, while the other end (the proximal end) is linked to a portion of the actuator that is moveable in response to user input, either manually or via wireless signal. In above layout embodiments, the connecting rod is preferably linked to the throw bar, which is preferably integrated with the actuator.

For applications involving below layout installations, manual switch actuator embodiments comprise a housing having an electrical switch integrated therein. The electrical switch provides means for altering the distribution of electrical power to the rail segments, e.g., one of the two diverging tracks, and, if spring biased, means for maintaining position of the points relative to the mainline once the actuator has been operated. The electrical switch may comprise a lever pivotally positioned in the switch housing or a slide in place of the lever. By moving the electrical switch lever or slide in one direction, selected electrical contacts are linked, and by moving the switch lever or slide in the opposite direction it links another set of selected electrical contacts. In this manner, operation of the switch actuator both mechanically modifies the points of the switch, which will be described in detail below, and the electrification of the relevant track segments, when the same are operatively coupled to the switch and suitable power source. Electrical switches considered desirable for use in the manual switch actuators are of the double throw type (center "off" types of this switch are possible, but are less desirable), and may be single pole double throw (SPDT) or double pole double throw (DPDT). For reasons that will be elaborated on below, it is preferable to use spring biased levers or slides when selecting the appropriate electrical switch.

Also disposed in the housing, and operatively linked to the lever or slide of the electrical switch, is a slider. The slider is translationally mounted in the housing and defines a recess for receiving the lever or slide of the electrical switch. One purpose of the slider is to transform arcuate movement of an electrical switch lever to linear motion; if an electrical slide switch is used, such transformation is not necessary. Another purpose of the slider is to provide suitable connection means for linking the electrical switch movement to movement of the connecting rod, either directly or indirectly via additional structure. In these embodiments, the slide is also adapted to receive translational movement of a linkage operable by a user. Thus, translation of the slider results in reciprocating movement of the electrical switch toggle or slide.

At this point, it is possible to directly link the slider to the proximal end of the connecting rod, thus linking the actuator with the throw bar of the switch. Depending upon the orientation of the actuator relative to the throw bar, such linkage may be sufficient. However, in certain below layout embodiments, it is desirable to reverse the direction of slider movement such that the distal end of the connecting rod (the end which engages the throw bar) moves in a direction similar to that of the slider. To this end, a lever arm is used. The lever arm is pivotally linked to the housing and includes a first end and a second end, where the pivot location is between the first and second ends. The first end is directly or indirectly linked to the slider, while the second end is linked to the proximal end of the connecting rod. Because the two ends move in opposite directions during pivoting of the lever arm, the throw direction of the connecting rod is reversed. As will be discussed in more detail below, inclusion of other linkage may also desirably or undesirably modify the throw direction for a given movement of the slider.

A benefit achieved through use of a spring-biased electrical switch is that once the electrical switch lever or slide passes dead neutral, the spring bias urges the lever or slide to the opposite position without further user input. If flexible linkage is incorporated into the actuator, preferably by using a flexible connecting rod, a soft bias at the switch points can be achieved. Moreover, precise calibration of the distal end connecting rod's throw is not needed, as excessive movement of the slide, actuator lever, and/or proximal end of the connecting rod can be "stored" by the elastic memory of the flexible linkage.

As an alternative to use of a spring-biased electrical switch and/or flexible linkage, the linkage between the input and the output can be modified to provide for such bias and throw accommodation. In particular, a spring-biased, bi-directional linkage between the electrical switch of the actuator and the switch throw bar can be used. In many embodiments, the spring-biased, bi-directional linkage is disposed between the connecting rod and one of the slider or the actuator lever. While a single spring may be used (e.g., a spring operative in both compression and tension modes), a pair of opposed springs, mounted within, for example, an elongate cavity formed in the slider where the connecting rod terminates at a block slidably mounted in the slider and between two compression springs, is considered preferable. As the slider is moved, the connecting rod moves therewith until the limit of points movement is reached, where after additional movement of the slider compresses/extends the springs but does not further significantly force the points against the desired tracks.

Many embodiments of the invention use a connecting rod fulcrum. The fulcrum is located between the two ends of the connecting rod and is moveably located on or in the housing. Through this movement with respect to the housing, the degree of connecting rod throw, one end relative to the other end, can be selected by a user (as is well known in the mechanical arts, alteration of a fulcrum point along a lever will modify the arcuate distance traveled by one end relative to the other end, as well as the mechanical advantage of one end relative to the other end). In this manner, the degree of throw at the throw bar, to which the distal end of the connecting rod links, can be matched to the requirements of the switch. This feature is especially important with respect to below layout installations wherein the distance between the actuator and the switch is variable. It should also be noted that incorporation of a fulcum, slidable or not, functionally reverses the throw direction of the distal end of the connecting rod for any given movement of the slider.

A feature present in many embodiments is a damper. The damper may be located in or on the housing, and preferably engages any one of the moving linkages in the switch actuator, e.g., the slider or the lever. The purpose of the damper is to decrease the speed at which any of the linked components move, thereby establishing slower movement of the switch when the actuator is linked thereto. This slowed movement better emulates the desired scaled speed of the points movement, thus enhancing realism of the switch. This feature is particularly important when a spring-biased electrical switch is used; the damped motion mitigates the "snap" action of the spring-biased electrical switch. The damper may be any visco-elastic element. In addition, the damper may find particular utility in embodiments employing the spring-biased bidirectional linkage; if a single spring is used, with respect to the previously described embodiment, then the damper may take the form of a micro "shock absorber" or other valved fluid body disposed opposite to the spring.

While any form of suitable linkage from an engineer's station to the switch actuator is acceptable, the slider is particularly suited for receiving translational input. A preferred means for such input is the use of a shielded cable. Such cables have a flexible core surrounded by a jacket. By linking a distal end of the jacket to the housing and a distal end of the core to the slider, movement of the core relative to the jacket at the proximal end results in desired translation of the slider, when suitable cable alignment is used. Those persons skilled in the art will appreciate the myriad mechanical arrangements available for establishing reciprocating translational input, or substantially reciprocating translational input; the objective is to avoid excessive forces not in the vector of slider movement.

Where it is possible to select the nature of the mechanical input to the switch actuator, certain components may be removed without departing from the invention. For example, the actuator lever can be directly linked to the lever of the electrical toggle switch at one end, and linked to the proximal end of the connecting rod at the other end. By directly linking the engineer's mechanical input to at least one end of the actuator lever, the invention retains its operability and complexity of the actuator is reduced. Naturally, arcuate movement of the lever is to be taken into consideration, but given the rather limited throw of the lever and the ability of a cable linkage from the engineer's station to the switch actuator to tolerate limited arcuate movement of the distal end of the core, such an arrangement is wholly acceptable. If a different linkage is contemplated, it can be constructed to provide the desired travel geometry to match or substantially match the travel geometry of the actuator lever. Similarly, the slider may function as the sole linkage between the electrical switch and the proximal end of the connecting rod.

The invention also comprises a radio controlled servo motor as opposed to a manual actuator. In such embodiments of the invention, the servo motor pinion is geared and meshes with a reduction gear, preferably mounted to a housing for the servo motor. The output gear of the reduction gear then engages with a rack, which links with the proximal end of the connecting rod to create a reciprocating motion. If circuitry is not provided within the servo motor housing for redirecting current to different track segments, an electrical switch can be linked to the rack in a similar manner to that employed in the manual actuators, e.g., the lever or slide of the electrical switch can be disposed in a recess formed in the rack, such that upon reciprocation of the rack the connections of the electrical switch can be modified.

DESCRIPTION OF THE INVENTION EMBODIMENTS

Figure 1:
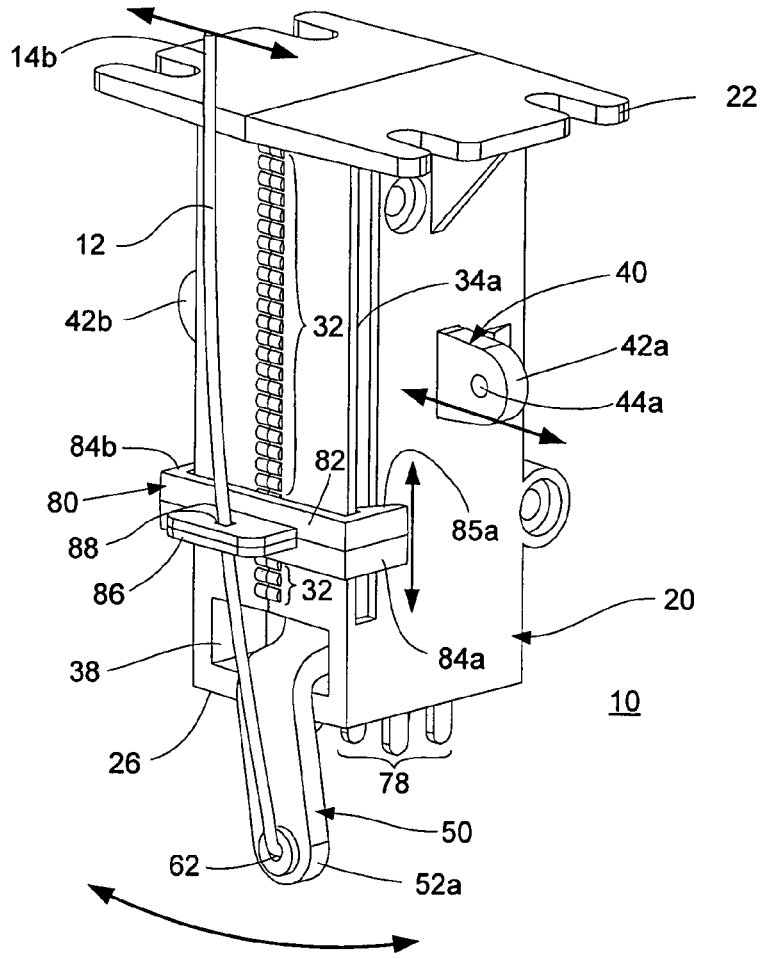
FIG. 1 is a first perspective view of a below layout manual switch activator according to the invention.
Figure 2:
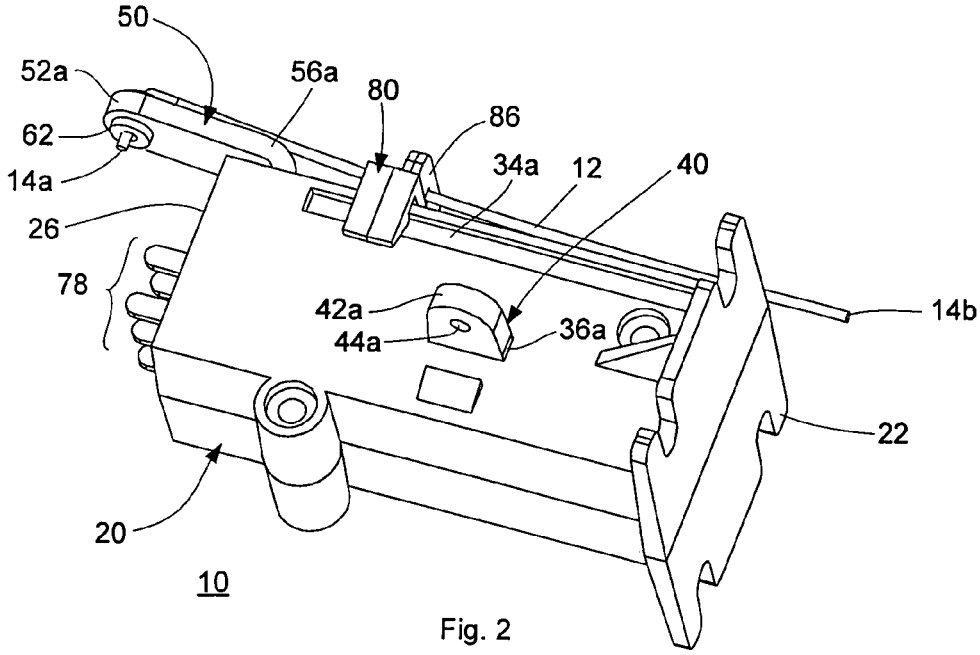
FIG. 2 is a second perspective view of a below layout base manual switch activator according to the invention.

The following discussion is presented to enable a person skilled in the art to make and use the embodiments of the invention. Various modifications to the embodiments will be readily apparent to those skilled in the art, and the generic principles herein may be applied to other embodiments and applications without departing from the spirit and scope of the present invention as defined by the appended claims. Thus, the present invention is not intended to be limited to the embodiments show, but is to be accorded the widest scope consistent with the principles and features disclosed herein.

Turning then to the several Figures wherein like numerals indicate like parts and more particularly to FIGS. 1-4, a first switch actuator 10 is shown. Switch actuator 10 comprises housing 20 slider 40 lever 50 switch 70 and fulcrum 80. In particular, housing 20 includes mounting base 22 switch end 26, detents 32 fulcrum slots 34*a* and 34*b*, slider slots 36*a* and 36*b*, and lever arm slot 38. Internally, which can be best viewed in FIG. 4, housing 20 includes switch housing receiver 28 and switch shaft receiver 30.

Slider 40 is translationally received by housing 20 through slider slots 36*a* and 36*b*. Slider 40, which engages switch handle 76 of switch 70 via toggle receiver 46, reciprocates within slider slots 36*a* and 36*b*, thereby permitting switch handle 76 to pivot within switch collar 74. This action, in turn, selectively couples conductor 78 of switch 70, in ways well know to those skilled in the art. In addition to toggle receiver 46, slider 40 includes lever pivot 48. As will be discussed in greater detail below, lever pivot 48 functionally links lever 50 with switch 70. External to housing 20, slider 40 includes ends 42*a* and 42*b*, which respectively define holes 44*a* and 44*b*. As will be discussed in more detail in FIG. 5, these features of slider 40 are useful in coupling remote control features to switch actuator 10.

Figure 3:
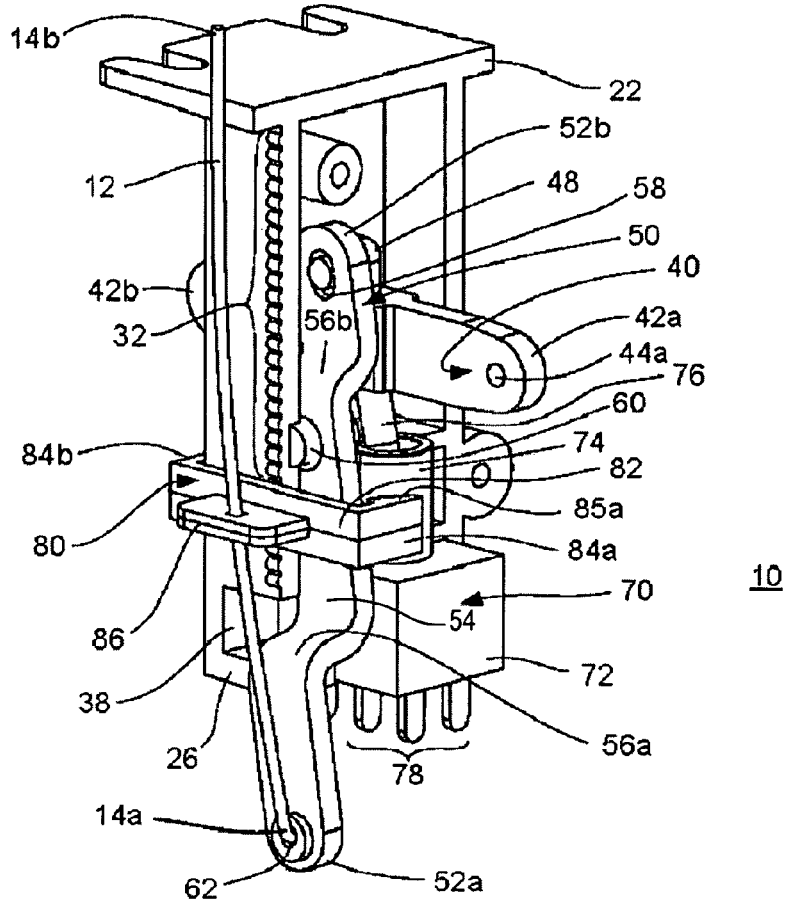
FIG. 3 is a cut away view of the embodiment of FIG. 1, particularly showing the internal linkages of the actuator.
Figure 4:
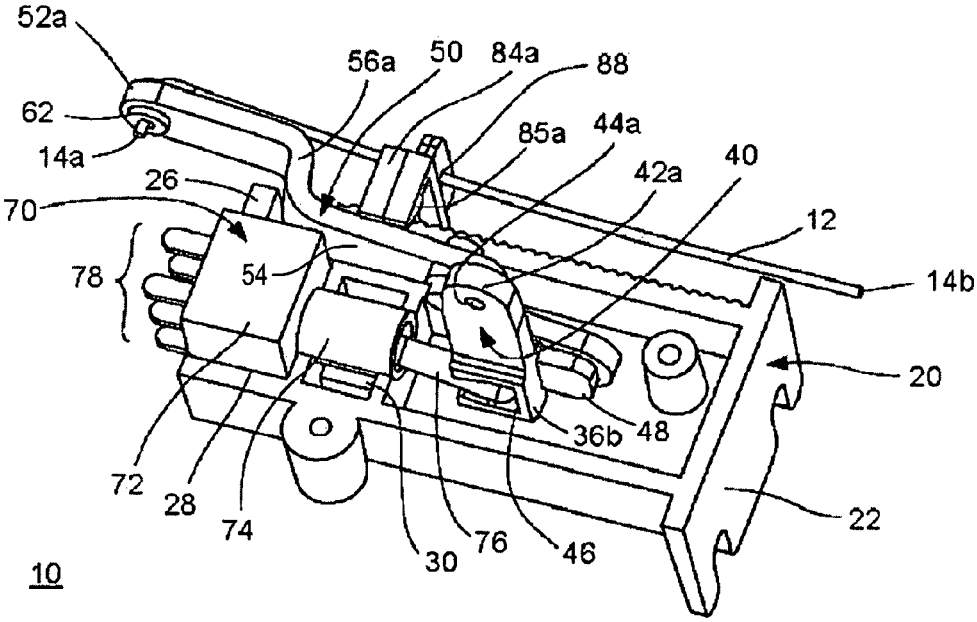
FIG. 4 is a cut away view of the embodiment of FIG. 2, particularly showing the internal linkages of the actuator.

Previously referenced lever 50, includes ends 52*a* and 52*b*, which bound body portion 54. Body portion 54 further includes offsets 56*a* and 56*b*, as best illustrated in FIG. 3. Means are provided in the form of slider linkage location 58 for receiving a lever pivot 48 of slider 40. In this manner, a suitable mechanical linkage is established between lever 50 and slider 40. Reciprocation of slider 40 is transformed into pivotal motion of lever 50 due to the engagement of central pivot location 60 with an interior receiving feature of housing 20. As a consequence of this geometry, connecting rod pivot location 62 similarly albeit inversely pivots about central pivot location 60. When connecting rod 12 is engaged with connecting rod pivot location 62, and hole 88 of fulcrum locator 86 receives a mid-body portion of connecting rod 12, pivotal motion of connecting rod pivot location 62 causes corresponding but inverse reciprocation of end 14*b* of connecting rod 12.

The degree of throw or arcuate motion of end 14*b* of connecting rod 12 is determined by the relative location of fulcrum 80 on housing 20. Fulcrum 80 includes body portion 82 from which extends locator 86, and is surrounded by legs 84*a* and 84*b*, which include fulcrum slot followers 85*a* and 85*b* for engaging with fulcrum slots 34*a* and 34*b* of housing 20. A detent engaging protrusion on the side opposite locator 86 selectively engages detents 32 of housing 20. Thus, incidental or unintended movement of fulcrum 80 vis-à-vis housing 20 is functionally eliminated by the engagement of the detent engaging protrusion with the detents 32 of housing 20. Relocation of fulcrum 80 can be accomplished either by disengaging fulcrum slot followers 85*a* or 85*b* from fulcrum slots 34*a* or 34*b*, or by overcoming the translational resistance of the interaction between detents 32 and the detent engaging protrusion of fulcrum 80.

Figure 5:
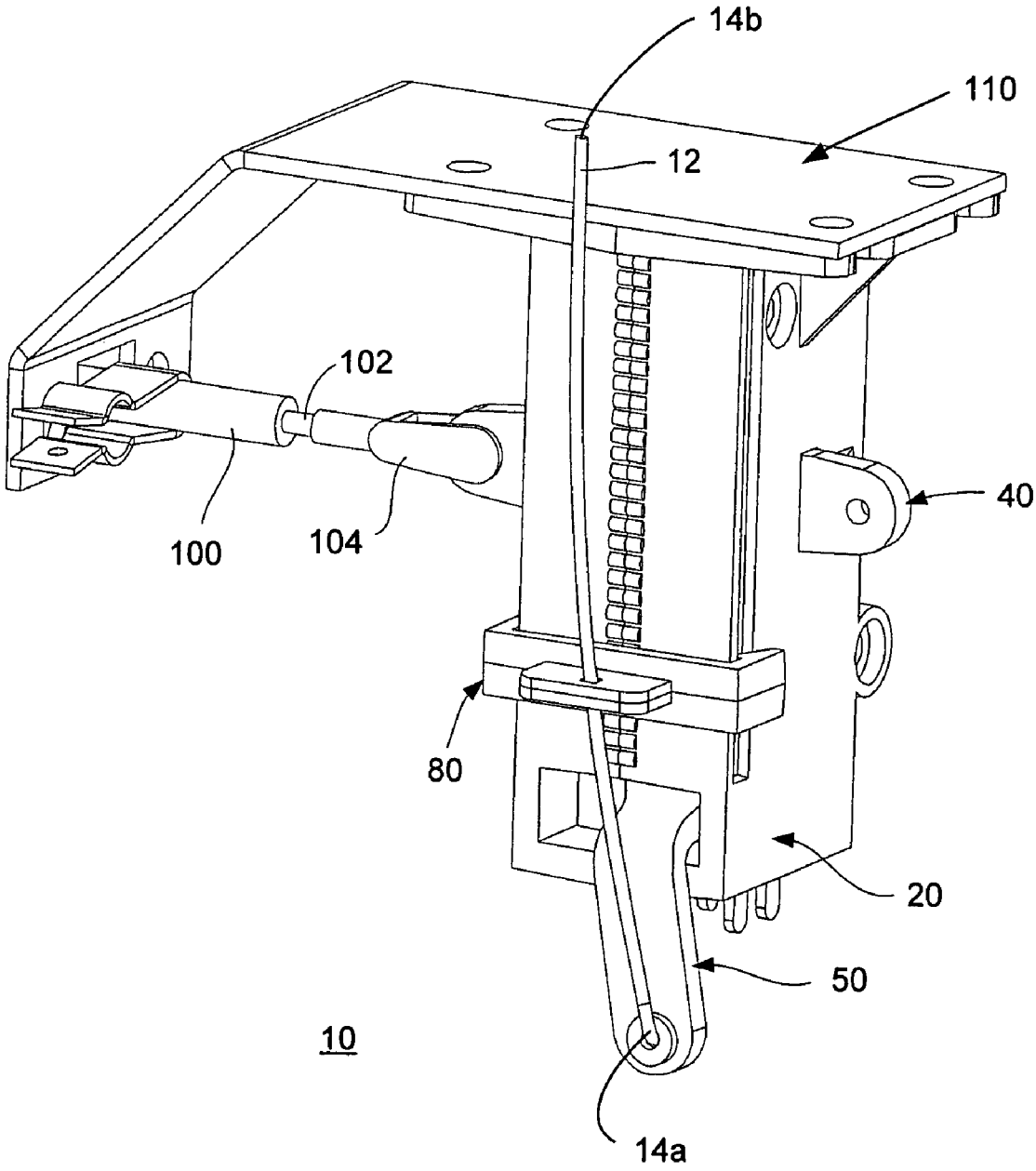
FIG. 5 is a second perspective view of the embodiment of FIG. 1 shown coupled to reciprocating cable arrangement to provide for remote manual activation of the activator.

Turning then to FIG. 5, an intended state of operation of switch actuator 10 is shown. Here, cable 102, which terminates in a clevis member 104, and which is housed within sheaving 100, provides a desired level of reciprocating translation motion to slider 40. Bracket 110, which is mounted to mounting base 22 of housing 20, provides suitable means for receiving sheaving 100 and providing a mechanical ground with respect to housing 20. Due to the intrinsic geometry of the disclosed embodiment, a pulling motion of cable 102 results in a correspondingly directed motion of end 14*b* of connecting rod 12. This congruity between the operator's directional motion and the resulting switch motion is considered highly desirable by model railroaders.

Figure 6:
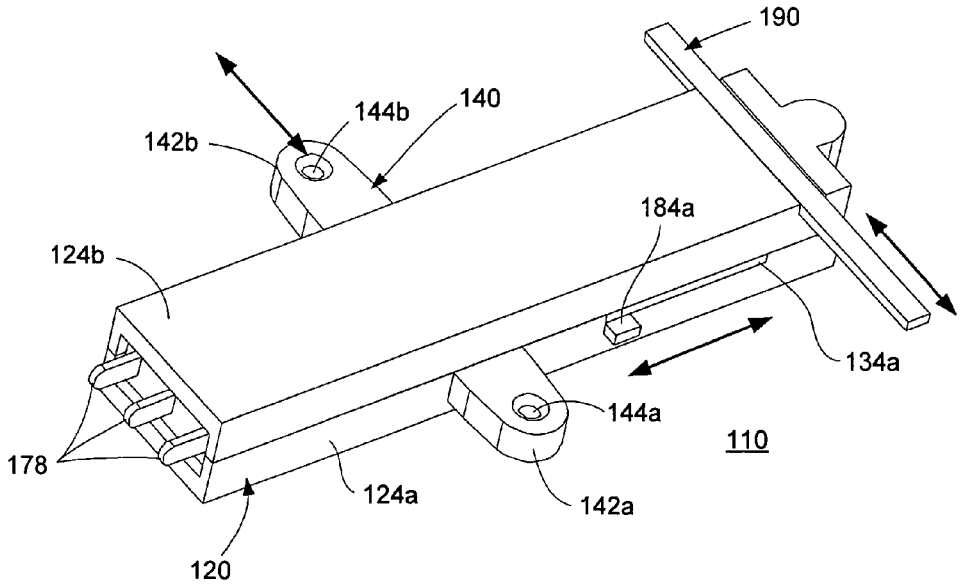
FIG. 6 is a first perspective view of an under switch manual switch activator according to the invention.
Figure 7:
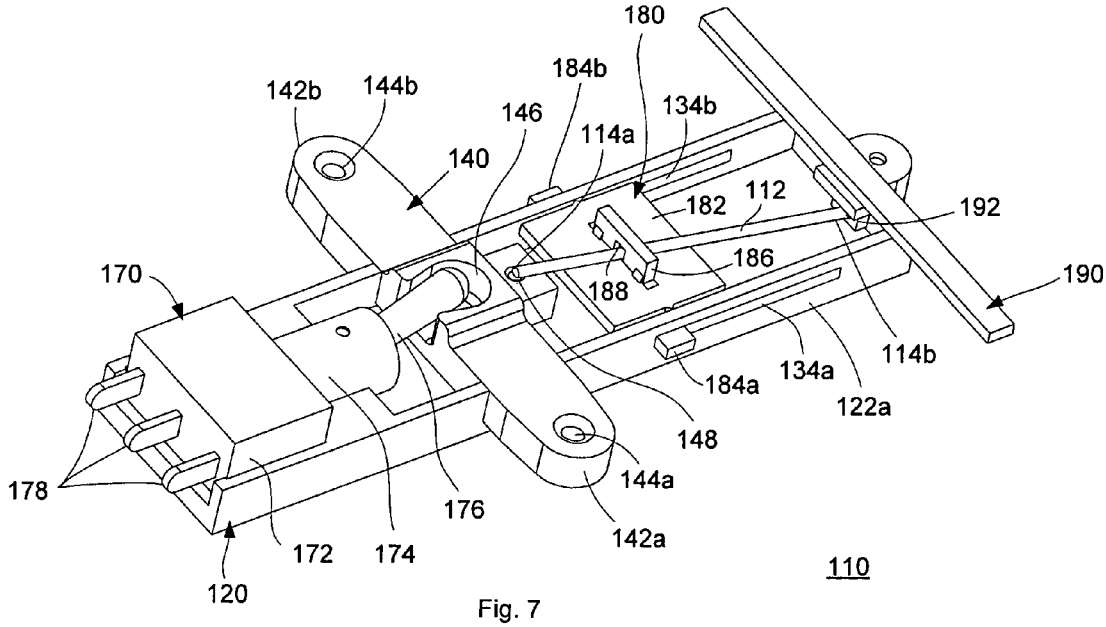
FIG. 7 is a cut away view of the embodiment of FIG. 6, particularly showing the internal linkages of the actuator.
Figure 8:
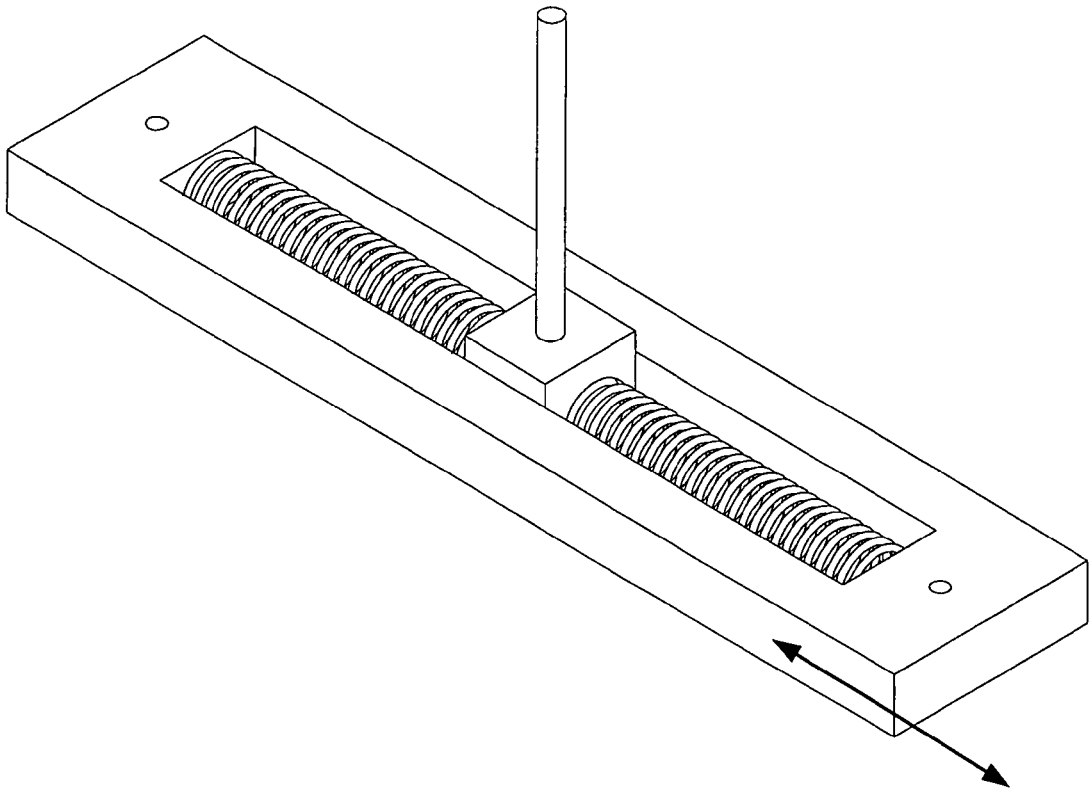
FIG. 8 is a perspective view of a spring-biased bi-directional linkage used to accommodate various throw bar arrangements and throw distances without the need for precise determinations of the same.

Turning next to FIGS. 5 and 6, an alternative embodiment of the invention is shown. Here, switch actuator 110 is shown as a surface mount embodiment. Again, present are housing 120, slider 140, switch 170, and fulcrum 180. In addition, throw bar 190 is provided to engage with the layout switch. As with the previously described embodiment, housing 120 includes slider 40 having ends 142*a* and 142*b*, which again define holes 144*a* and 144*b*, respectively. Additionally, slider 40 includes toggle receiver 46, for coupling switch 170 therewith. Unlike the prior embodiment, however, lever pivot 48 is replaced by connecting rod pivot 148. By this direct coupling, throw direction reversing lever 50 is eliminated. However, it remains desirable to include means for adjusting the degree of throw bar 90 throw, and therefore fulcrum 180 is provided.

Disposed within housing 120, fulcrum 180 includes body portion 182 that is translationally received within housing 120 via the interactions of legs 184*a* and 184*b* with fulcrum slots 134*a* and 134*b*, respectively. Fulcrum locator 86 again is present, which defines hole 188 for receiving the mid-body portion of connecting rod 112. Again, due to the geometry, pivotal motion by end 114*a* through its interaction with connecting rod pivot 148, and locator 186, causes corresponding but opposite directional movement of connecting rod end 114*b*. Given this components engagement with receiver 192 of throw bar 90, throw bar 90 is cause to translate upon complimentary translation of slider 140. Again, similar fulcrum motion resisting means may be provided in the form of detents, such as by creating the same on an internal surface of housing 120 and the reverse or hidden side of fulcrum 180.

Figure 9:
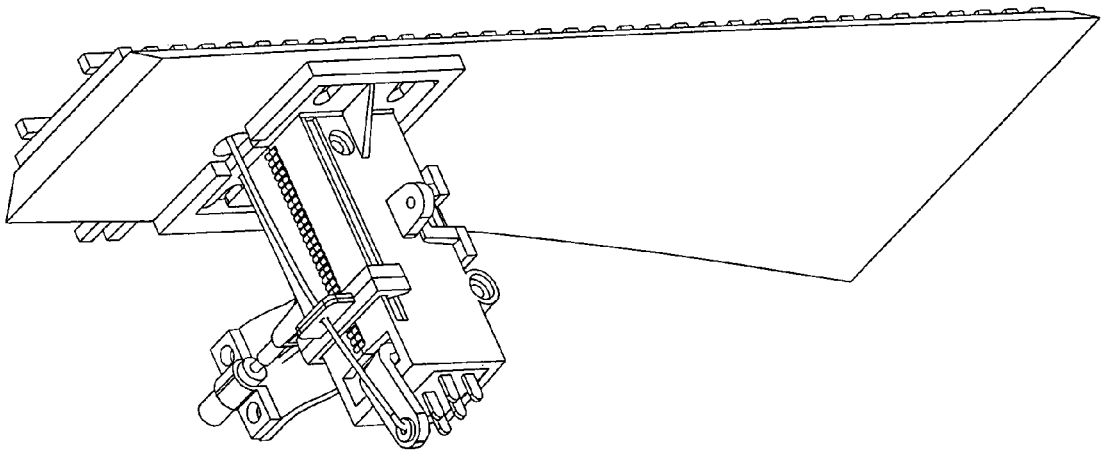
FIG. 9 is a perspective view of the embodiment shown in FIG. 5 mounted to the underside of a layout base.
Figure 10:
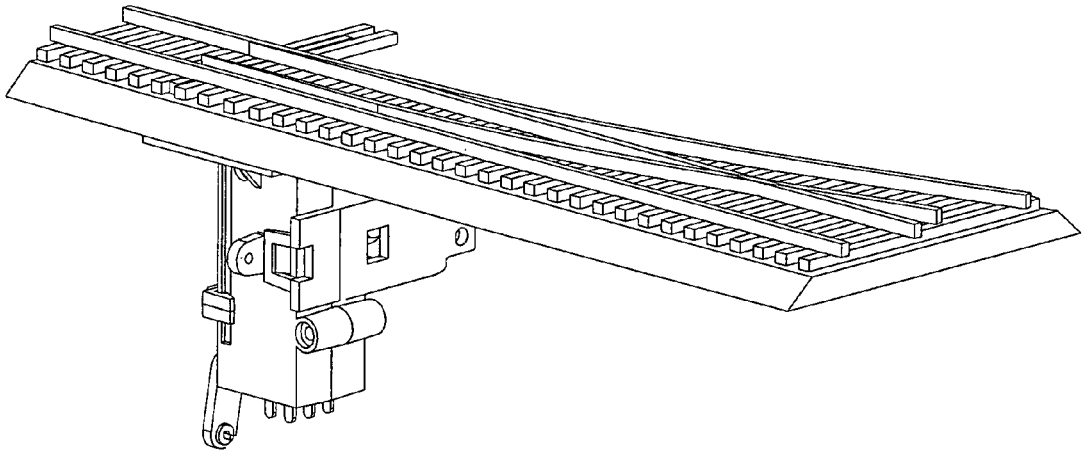
FIG. 10 provides another perspective of the embodiment shown in FIG. 9.
Figure 11:
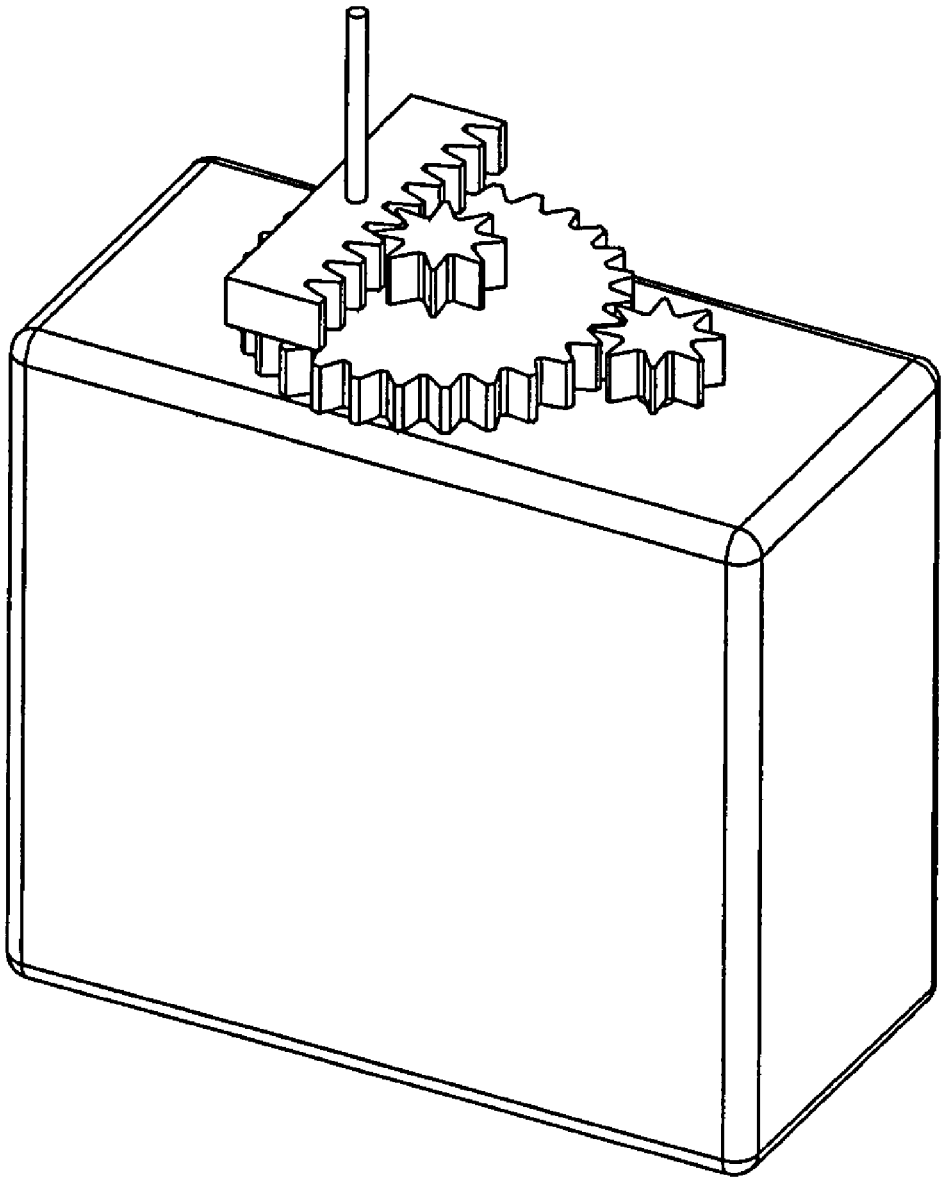
FIG. 11 is a perspective schematic view of a radio controlled switch activator.
Figure 12:
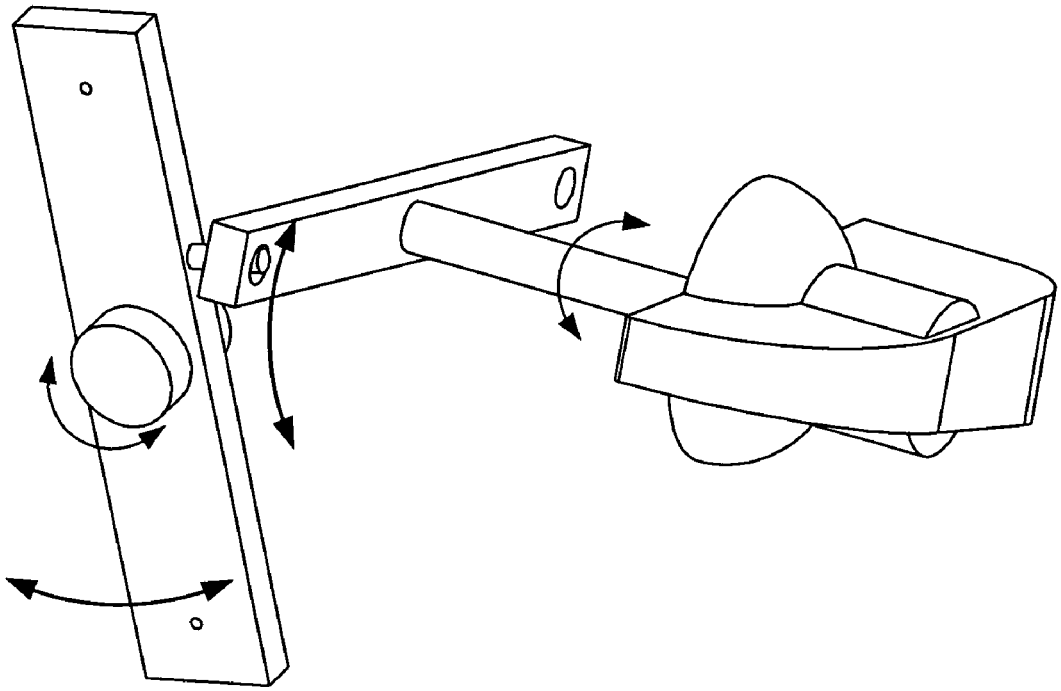
FIG. 12 is a perspective schematic view of a translation linkage for changing rotary motion in one plane to substantially linear motion in another plane.

FIGS. 9 and 10 represent two views of switch actuator 10 shown mounted to a layout segment via mounting brace bracket 116. The incorporation of mounting base bracket 116 within the layout segment facilitates the convenient and accurate mounting of switch actuator 10 therein. Suitable adjustments can then be made via fulcrum 80 and the anchoring configuration of cable sheaving 100 with brackets 110.

What is claimed:

1. A switch actuator comprising:

a housing adapted to receive an electrical switch having a toggle;

a slider translationally received by the housing and linked to the toggle; and a fulcrum for receiving mid portion of a connecting rod wherein the slider has means for receiving a first end portion of the connecting rod.

2. The switch actuator of claim 1 wherein the fulcrum is positionable along a portion of the housing to alter connecting rod range of motion.

3. The switch actuator of claim 2 wherein the fulcrum translates along a portion of the housing in a direction substantially orthogonal to the direction of slider translation.

4. The switch actuator of claim 1 wherein the fulcrum is internal to the housing.

5. The switch actuator of claim 4 wherein the fulcrum is positionable along a portion of the housing to alter connecting rod range of motion.

6. The switch actuator of claim 1 wherein the fulcrum is external to the housing.

7. The switch actuator of claim 6 wherein the fulcrum is positionable along a portion of the housing to alter connecting rod range of motion.

8. The switch actuator of claim 1 wherein the fulcrum comprises a bore through which the connecting rod may pass.

9. The switch actuator of claim 1 further comprising a through bar translationally linked with the housing and linked to the connecting rod at a second end thereof.

10. A switch actuator for a model railroad comprising:

a housing adapted to receive an electrical switch having a toggle;

a slider translationally received by the housing and linked to the toggle;

a connecting rod having a first end linked to the slider, a second end for receiving a portion of a throw bar, and a body portion having a pivot point to functionally engage with a portion of the housing; and a fulcrum for receiving a mid portion of the connecting rod.

11. The switch actuator of claim 1 further comprising a remote operation assembly linked at one end thereof to the slider.

12. The switch actuator of claim 10 wherein the fulcrum comprises a U-shaped member having two legs, each having distal ends, and connected to each other by a web, and the distal ends slidingly engage the housing.

13. The switch actuator of claim 10 wherein the fulcrum is positionable along a portion of the housing to alter connecting rod range of motion.

14. The switch actuator of claim 13 wherein the fulcrum translates along a portion of the housing in a direction substantially orthogonal to the direction of slider translation.

15. The switch actuator of claim 10 wherein the fulcrum is internal to the housing.

16. The switch actuator of claim 15 wherein the fulcrum is positionable along a portion of the housing to alter connecting rod range of motion.

17. The switch actuator of claim 10 wherein the fulcrum is external to the housing.

18. The switch actuator of claim 17 wherein the fulcrum is positionable along a portion of the housing to alter connecting rod range of motion.

19. The switch actuator of claim 10 wherein fulcrum comprises a bore through which the connecting rod may pass.

20. The switch actuator of claim 10 further comprising a remote operation assembly linked at one end thereof to the slider.

* * * * *